US007609124B2

(12) United States Patent
Mukai et al.

(10) Patent No.: US 7,609,124 B2
(45) Date of Patent: Oct. 27, 2009

(54) NON-RECIPROCAL CIRCUIT DEVICE

(75) Inventors: Yoshiyuki Mukai, Tottori (JP); Shinji Yamamoto, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 149 days.

(21) Appl. No.: 11/671,283

(22) Filed: Feb. 5, 2007

(65) Prior Publication Data

US 2007/0182504 A1 Aug. 9, 2007

(30) Foreign Application Priority Data

Feb. 7, 2006 (JP) ..... 2006-029088

(51) Int. Cl.
*H01P 1/387* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS

2006/0017520 A1 1/2006 Kingston et al.
2006/0139118 A1* 6/2006 Vaughn et al. ..... 333/1.1

FOREIGN PATENT DOCUMENTS

EP 1619744 A1 1/2006
GB 2352564 A 1/2001
JP 55-083302 6/1980
JP 2003-124711 4/2003
JP 2003124711 4/2003
JP 2005-184676 7/2005

* cited by examiner

*Primary Examiner*—Stephen E Jones
(74) *Attorney, Agent, or Firm*—Sughrue Mion, PLLC

(57) ABSTRACT

A non-reciprocal circuit device comprising a metal case, a ground plate disposed on an inner bottom surface of the metal case, a resin member disposed on the ground plate and having an opening from which the ground plate is exposed, a planar microwave ferrite member disposed in the opening of the resin member, a strip line member disposed on the planar microwave ferrite member, and a permanent magnet disposed with distance on the strip line member without another planar microwave ferrite member therebetween, the strip line member comprising a connecting portion constituted by strip electrodes radially extending from a center portion, and branch lines radially extending from the center portion between the strip electrodes, low-impedance lines each integrally connected to each of the branch lines and extending along the periphery of the planar microwave ferrite member, and electrodes each integrally connected to each of the low-impedance lines, whereby the branch lines and the ground plate form microstrip lines, and the low-impedance lines and the ground plate form a grounded capacitor.

5 Claims, 8 Drawing Sheets

NON-RECIPROCAL CIRCUIT DEVICE

FIELD OF THE INVENTION

The present invention relates to a non-reciprocal circuit device such as an isolator or a circulator used as microwave-band, high-frequency parts for automobile phones, cell phones, etc.

BACKGROUND OF THE INVENTION

In general, the non-reciprocal circuit device such as an isolator or a circulator has a function to pass a signal only in a transmitting direction, while blocking the transmission of a signal in an opposite direction. Such isolator and circulator have a distribution constant type and a lumped constant type. FIGS. 10 and 11 show the structure of a distribution-constant-type, non-reciprocal circuit device. This non-reciprocal circuit device comprises a metal case 9, a strip line member 8 having three input/output electrodes 8*a*, 8*b*, 8*c* radially extending from a circular center portion 80, which may be called central conductor, a pair of disc-shaped microwave ferrite members 7, 7 sandwiching the strip line member 8 coaxially with the circular center portion 80, and a pair of permanent magnets 4, 4 disposed on both sides of the disc-shaped microwave ferrite members 7, 7 for applying a DC magnetic field thereto. Only one permanent magnet 4 may be used. The metal case 9 is provided on the sidewall with connectors 20 (20*a*, 20*b*, 20*c*), a center terminal 50 of each connector 20*a*, 20*b*, 20*c* being connected to each input/output electrode 8*a*, 8*b*, 8*c* of the strip line member 8.

FIG. 12 shows the appearance of a distribution-constant-type, non-reciprocal circuit device disclosed by JP2003-124711A, and FIG. 13 shows its internal structure. This non-reciprocal circuit device 1 comprises an upper iron plate 3, a permanent magnet 4, a lower iron plate 5, an upper ground plate 6*a*, two ferrite plates (disc-shaped garnet ferrite members) 7, 7, a central conductor 8 having three input/output electrodes 8*a*, 8*b*, 8*c* radially extending at intervals of 120°, which is sandwiched by the two ferrite plates 7, 7, and a lower ground plate 6*b*, in this order from above between a metal case 9 and an upper lid 2. The central conductor 8 is usually formed by a thin copper plate of 0.1-0.25 mm, and its three input/output electrodes 8*a*, 8*b*, 8*c* respectively project from three slits formed in the sidewall of the metal case 9, with their tip end portions bent and soldered to a circuit board.

The strip line member 8 comprises a resonance portion (substantially triangular center portion) 80 resonating in a TM110 mode, three input/output electrodes 8*a*, 8*b*, 8*c* radially extending from the resonance portion 80, and impedance converters each as long as $\lambda/4$ and disposed between the resonance part 80 and each input/output electrode (branched line) 8*a*, 8*b*, 8*c* for impedance matching. When current is supplied to the strip line member 8, a high-frequency magnetic field is generated from the disc-shaped microwave ferrite members 7, 7 such that it surrounds the strip line member 8. Because the permanent magnet 4 generates a rotating magnetic field in the disc-shaped microwave ferrite members 7, 7, the polarization plane of the high-frequency magnetic field rotates when passing through the planar microwave ferrite members 7, 7, giving an output only to a predetermined branched line 8*a*, 8*b*, 8*c* (exhibiting non-reciprocality).

Increasingly higher demand for size and cost reduction is mounting on such distribution-constant-type, non-reciprocal circuit devices. However, because the size of a planar microwave ferrite member is substantially determined by an operating frequency of the non-reciprocal circuit device, two-dimensional size reduction is difficult. Attempts to reduce the thickness of a non-reciprocal circuit device have thus been conducted by enhancing the performance of permanent magnets, making uniform a magnetic flux by combining one permanent magnet with a magnetic yoke or a pole piece, etc. However, thickness reduction is limited, because the non-reciprocal circuit device has a structure in which a planar microwave ferrite member, a strip line member, and a permanent magnet are stacked.

OBJECTS OF THE INVENTION

Accordingly, an object of the present invention is to provide a non-reciprocal circuit device with reduced thickness and price without deteriorating electric characteristics.

DISCLOSURE OF THE INVENTION

The non-reciprocal circuit device of the present invention comprises a metal case, a ground plate disposed on an inner bottom surface of the metal case, a resin member disposed on the ground plate and having an opening from which the ground plate is exposed, a planar microwave ferrite member disposed in the opening of the resin member, a strip line member disposed on the planar microwave ferrite member, and a permanent magnet disposed with distance on the strip line member without another planar microwave ferrite member therebetween, the strip line member comprising a connecting portion constituted by strip electrodes radially extending from a center portion, and branch lines radially extending from the center portion between the strip electrodes, low-impedance lines each integrally connected to each of the branch lines and extending along the periphery of the planar microwave ferrite member, and electrodes each integrally connected to each of the low-impedance lines, whereby the branch lines and the ground plate form microstrip lines, and the low-impedance lines and the ground plate form a grounded capacitor.

A partition member is preferably disposed between the strip line member and the permanent magnet to maintain a gap therebetween. To arrange the permanent magnet at high precision for a uniform DC magnetic field distribution in the planar microwave ferrite member, the partition member preferably has a flange for supporting the sidewall of the permanent magnet. To avoid softening even in a high-temperature environment by solder reflow, etc., the partition member is preferably made of heat-resistant resins such as liquid crystal polymers, polyphenylene sulfide, polybutylene terephthalate, polyetheretherketone, epoxy resins, etc.

Because the dielectric loss of the permanent magnet is as large as 100 times that of the planar microwave ferrite member, the deterioration of electric characteristics is unavoidable when the permanent magnet is close to the strip line member. Accordingly, the gap T between the strip line member and the permanent magnet is preferably equal to or larger than the thickness of the planar microwave ferrite member. However, too large a gap T not only nullifies the thickness reduction, but also weakens a DC magnetic field applied from the permanent magnet to the planar microwave ferrite member and makes its distribution non-uniform. Accordingly, the gap T preferably does not exceed 3 times the thickness of the planar microwave ferrite member.

When the planar microwave ferrite member is too thin, it neither has enough strength nor provides necessary inductance, resulting in deviations in input/output impedance. As a result, the insertion loss increases, and the passband width is narrowed. Although inductance can be adjusted by changing the width of line portions of a strip line member, and a grounded capacitor constituted by a low-impedance line and a ground plate, such adjustment is limited. Accordingly, the thickness of the planar microwave ferrite member is preferably 0.3 mm or more, more preferably 0.5 mm or more.

DESCRIPTION OF THE PREFERRED EMBODIMENTS

Figure 1:
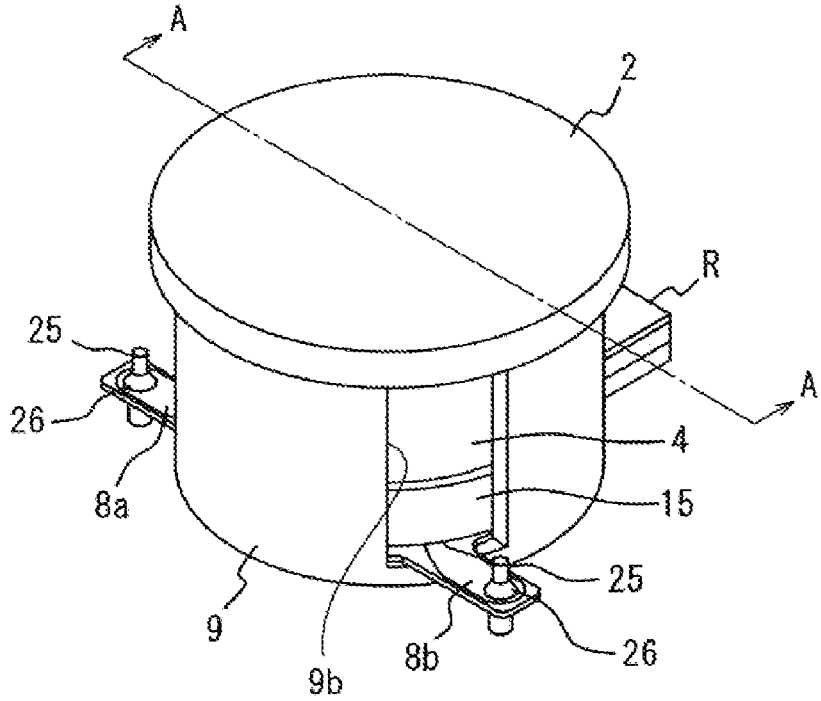
FIG. 1 is a perspective view showing the appearance of a non-reciprocal circuit device according to one embodiment of the present invention.
Figure 2:
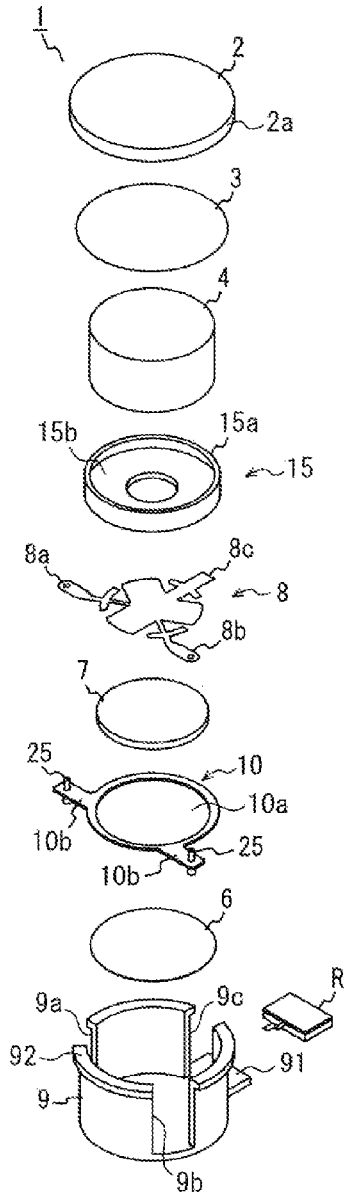
FIG. 2 is an exploded perspective view showing the internal structure of a non-reciprocal circuit device according to one embodiment of the present invention.
Figure 3:
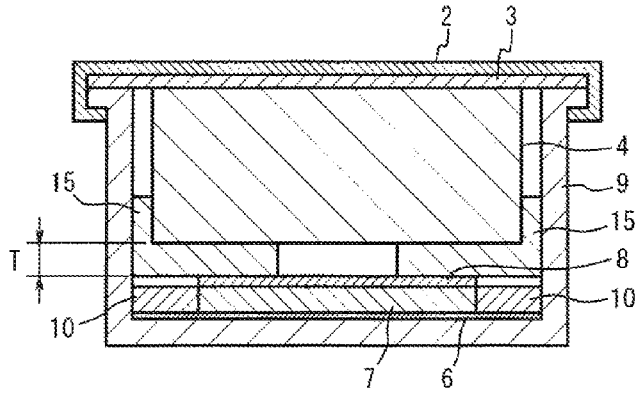
FIG. 3 is a cross-sectional view taken along the line A-A in FIG. 1.
Figure 4:
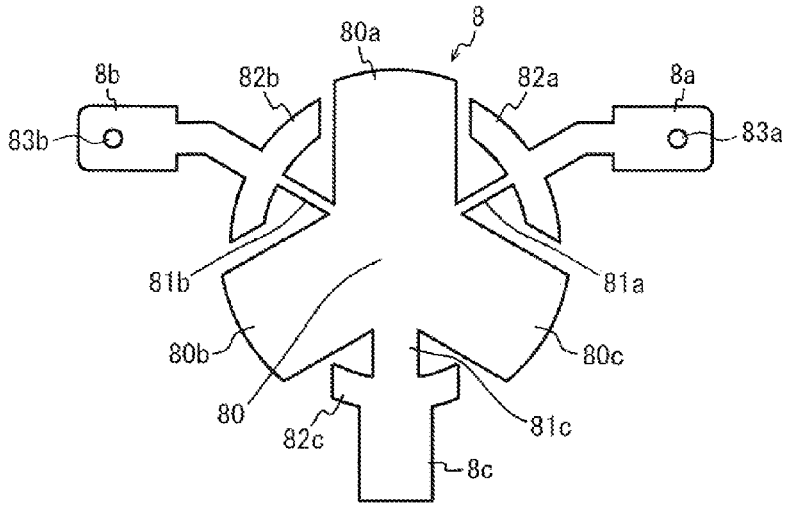
FIG. 4 is a plan view showing one example of a microstrip line member used in a non-reciprocal circuit device according to one embodiment of the present invention.
Figure 5:
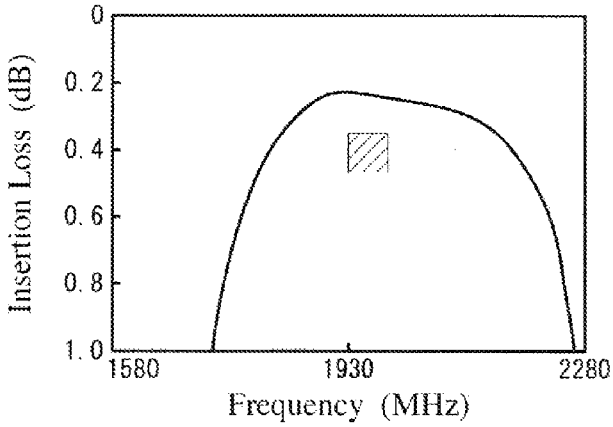
FIG. 5 is a graph showing the insertion loss characteristics of a non-reciprocal circuit device according to one embodiment of the present invention.
Figure 6:
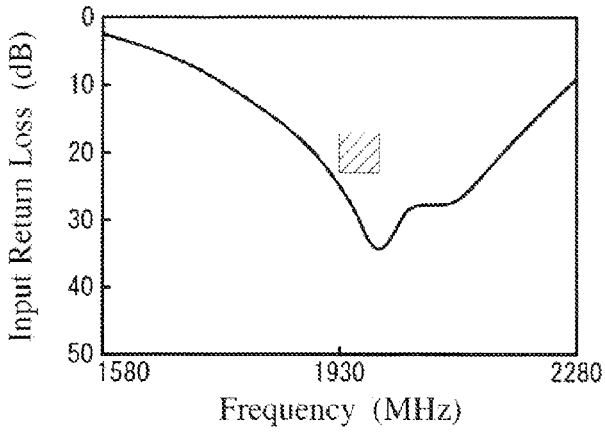
FIG. 6 is a graph showing the input return loss characteristics of a non-reciprocal circuit device according to one embodiment of the present invention.
Figure 7:
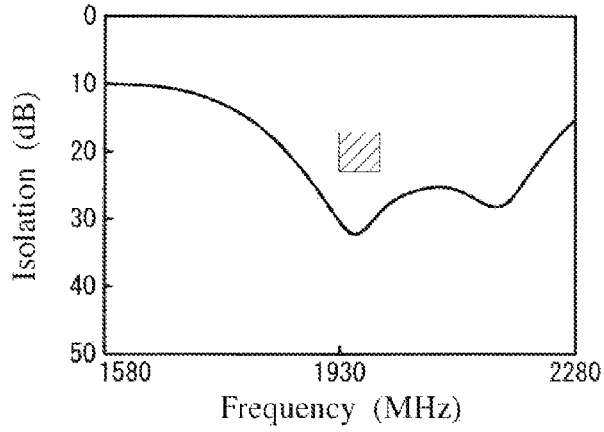
FIG. 7 is a graph showing the isolation characteristics of a non-reciprocal circuit device according to one embodiment of the present invention.
Figure 8:
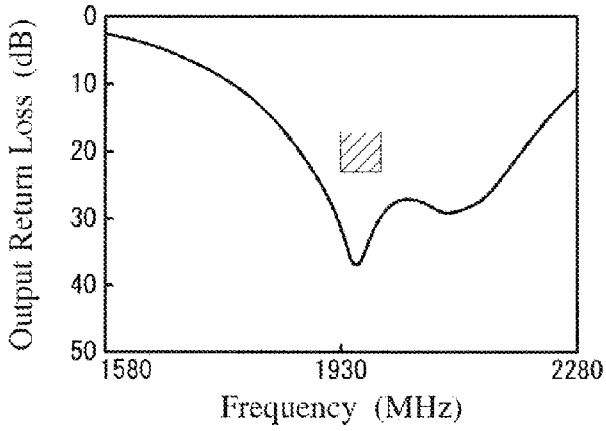
FIG. 8 is a graph showing the output return loss characteristics of a non-reciprocal circuit device according to one embodiment of the present invention.

FIGS. 1-3 show the appearance and internal structure of an isolator comprising a termination resistor, as the non-reciprocal circuit device according to one embodiment of the present invention. FIG. 4 shows a strip line member, which may be called "microstrip line member," used in this isolator.

This non-reciprocal circuit device has a structure comprising constituent members contained between a case 9 and a lid 2 both made of a magnetic metal for functioning as a magnetic yoke. The metal case 9 has a sidewall provided with three notches 9*a*, 9*b*, 9*c* with equal interval. A support plate 91 integrally and radially extends from a lower end of the notch 9*c* of the metal case 9 in the same plane as the inner bottom surface. Because the metal case 9 and the lid 2 act as paths of high-frequency current, they are preferably plated with a metal having small electric resistivity, for instance, Au, to have electric characteristics improved by the skin effect. The metal case 9 and the lid 2 preferably have electric resistivity of $1.0\times10^{-7}$ Ω·m or less.

A ground plate 6 formed by as thin a copper plate as about 0.02-0.2 mm is disposed on the inner bottom surface of the metal case 9. The ground plate 6 is provided with a protective plating of a metal having small electric resistivity, such as Ag and Au, to prevent oxidation. The protective plating preferably has electric resistivity of $1.0\times10^{-7}$ Ω·m or less.

Disposed on the ground plate 6 is a resin member 10 having a center opening 10*a*, from which the ground plate 6 is exposed, and arms 10*b*, 10*b* projecting from the notches 9*a*, 9*b* of the metal case 9. A metal pin terminal 25 is fixed into an aperture in a tip end portion of each arm 10*b*. Because the resin member 10 is made of resin materials having high rigidity and bending strength, such as glass-fiber-reinforced epoxy resins, liquid crystal polymers, etc., it is hardly deformed by an external force. Accordingly, the resin member 10 prevents the position of the terminal 25 from changing, thereby ensuring the terminals 25, 25 to be fixed into the apertures of the input/output electrodes 8*a*, 8*b* of the microstrip line member 8 and soldered thereto.

Disposed in the center opening 10*a* of the resin member 10 is a planar microwave ferrite member 7 set to operate at predetermined frequencies. In this embodiment, the planar microwave ferrite member 7 is formed by a disc-shaped garnet ferrite.

A microstrip line member 8 is disposed on the planar microwave ferrite member 7. FIG. 4 shows the shape of the microstrip line member 8. The microstrip line member 8 is formed by etching as thin a metal plate as about 30-250 μm. The microstrip line member 8 comprises (a) a connecting portion 80 comprising three strip electrodes 80*a*, 80*b*, 80*c* radially extending from a center portion to radial positions corresponding to the periphery of the disc-shaped microwave ferrite member 7, (b) branch lines 81*a*, 81*b*, 81*c* radially extending from the center portion between adjacent strip electrodes in length smaller than the radius of the disc-shaped microwave ferrite member 7, for instance, substantially half of the radius of the disc-shaped microwave ferrite member 7, (c) low-impedance lines 82*a*, 82*b*, 82*c* each integrally connected to a tip end portion of each branch line 81*a*, 81*b*, 81*c* and extending along the periphery of the disc-shaped microwave ferrite member 7, and (d) input/output electrodes 8*a*, 8*b*, 8*c* each integrally connected to an outer side of each low-impedance line 82*a*, 82*b*, 82*c*. Each electrode 8*a*, 8*b* has an aperture 83*a*, 83*b* receiving the terminal 25.

To make the branch lines 81*a*, 81*b*, 81*c* as long as λ/4, the area of the planar microwave ferrite member 7 occupied by the connecting portion 80 is extremely smaller than the area of the planar microwave ferrite member 7. The low-impedance lines 82*a*, 82*b*, 82*c* act as a matching circuit, compensating the deviations of an operating frequency and the narrowing of a bandwidth. The ground plate 6 forms a microstrip line with the branch lines 81*a*, 81*b*, 81*c*, and a grounded capacitor with the low-impedance lines 82*a*, 82*b*, 82*c*.

As shown in FIG. 1, each electrode 8*a*, 8*b* of the microstrip line member 8 projects from each notch 9*a*, 9*b* of the metal case 9. With the terminal 25 mounted to the tip end portion of each arm 10*b* of the resin member 10 penetrating the aperture 83*a*, 83*b* of each electrode 8*a*, 8*b*, each electrode 8*a*, 8*b* is soldered to each terminal 25. Also, the electrode 8*c* of the microstrip line member 8 projects from the notch 9*c* of the metal case 9, and is connected to termination resistor R disposed on the support plate 91.

When the non-reciprocal circuit device is used as a circulator, high-frequency power rotates through the connecting portion 80, the branch lines 81*a*, 81*b*, 81*c* and the low-impedance lines 82*a*, 82*b*, 82*c*. When the non-reciprocal circuit device is used as an isolator with a termination resistor R added to one terminal (third terminal) of the circulator, high-frequency power supplied to the first terminal is transmitted to the second terminal, while high-frequency power supplied to the second terminal is absorbed by the termination resistor R connected to the third terminal, so that it is not transmitted to the first terminal. However, if the termination resistor R contains a large reactance component at operating frequencies, impedance deviation would occur, resulting in the deterioration of electric characteristics. To compensate this, the branch line 81*c* connected to the termination resistor R is given a different width from those of the other branch lines 81*a*, 81*b*, and the low-impedance line 82*c* is given a different shape from those of the other low-impedance lines 82*a*, 82*b*.

A permanent magnet 4 is disposed on the strip line member 8, via a partition member 15 made of liquid crystal polymers, glass-fiber-reinforced epoxy resins, etc. The partition member 15 has a flange 15*a* for supporting the sidewall of the permanent magnet 4*a*, and a doughnut-shaped bottom portion 15*b* having a thickness T to define a gap T between the microstrip line member 8 and the permanent magnet 4.

A lid 2 made of a magnetic metal is disposed on the permanent magnet 4 via an iron plate 3. The iron plate 3 constitutes a magnetic yoke with the lid 2.

An important feature of the present invention is that with one disc-shaped microwave ferrite member 7 placed under the microstrip line member 8, the permanent magnet 4 is disposed on the microstrip line member 8 via an air layer without using another disc-shaped microwave ferrite member. Although it is conventionally considered that the insertion of an air layer not contributing to non-reciprocality makes the bandwidth of the non-reciprocal circuit device narrower, it has been found that the narrowing of bandwidth can be prevented by making the disc-shaped microwave ferrite member 7 thinner, and adjusting a gap between the microstrip line member 8 and the permanent magnet 4.

A specific example of the non-reciprocal circuit device of the present invention will be explained in detail below. Because its overall structure is the same as shown in FIGS. 1 and 2, the explanation of the overlapped portions will be omitted.

A 0.1-mm-thick, circular ground plate 6 was disposed on an inner bottom surface of a metal case 9 formed by a cold-rolled steel plate SPCC, which had a plating layer having a thickness of 5-30 μm comprising a Cu plating layer, a Ni plating layer and an Au plating layer in this order from below. A 0.5-mm-thick liquid crystal polymer member 10 having a center opening 10*a* was disposed on the circular ground plate 6, and a disc-shaped garnet ferrite member 7 having a diameter of 17 mm and a thickness of 0.5 mm, which had a specific dielectric constant $\in r$ of 11, a saturation magnetization $4\pi MS$ of 115 mT, and a dielectric loss Tan $\delta\in$ of $2\times10^{-4}$, was disposed on the center opening 10*a* of the resin member 10.

Disposed on the disc-shaped garnet ferrite member 7 was a microstrip line member 8 formed by etching a thin metal plate having a thickness of 150 μm. Disposed on the microstrip line member 8 was a 0.5-mm-thick partition member 15 made of a silicone resin. Disposed on the partition member 15 was a La—Co-containing ferrite permanent magnet 4 (YBM-9BE, available from NEOMAX) having a diameter of 20 mm and a thickness of 6.0 mm. This La—Co-containing ferrite permanent magnet has a residual magnetic flux density Br of 430-450 mT, and an intrinsic coercivity iHc of 382-414 KA/m. A gap between the microstrip line member 8 and permanent magnet 4 was regulated to 0.5 mm by the partition member 15.

A 0.2-mm-thick SPCC lid 2 was disposed on the permanent magnet 4 via a 0.8-mm-thick SPCC plate 3, and a flange of the lid 2 was caulked to an upper flange of the lower case 9 to fix the inside members. Because the lid 2 acting as a magnetic yoke was thin for ease of caulking, it was combined with the iron plate 3 to prevent magnetic saturation.

The electrodes 8*a*, 8*b*, 8*c* of the microstrip line member 8 were soldered to the terminals 25, 25 and the termination resistor R, respectively. The electric characteristics of the resultant 12.5-mm-high, non-reciprocal circuit device 1 were evaluated by a network analyzer. The results are shown in FIGS. 5-8. Hatched ports in the figures indicate the ranges of characteristics required for the non-reciprocal circuit device in a frequency bandwidth used. It is clear from FIGS. 5-8 that the non-reciprocal circuit device 1 had insertion loss lower than the required level, and input return loss, output return loss and isolation larger than the required levels in the frequency bandwidth used, indicating excellent electric characteristics.

Figure 14:
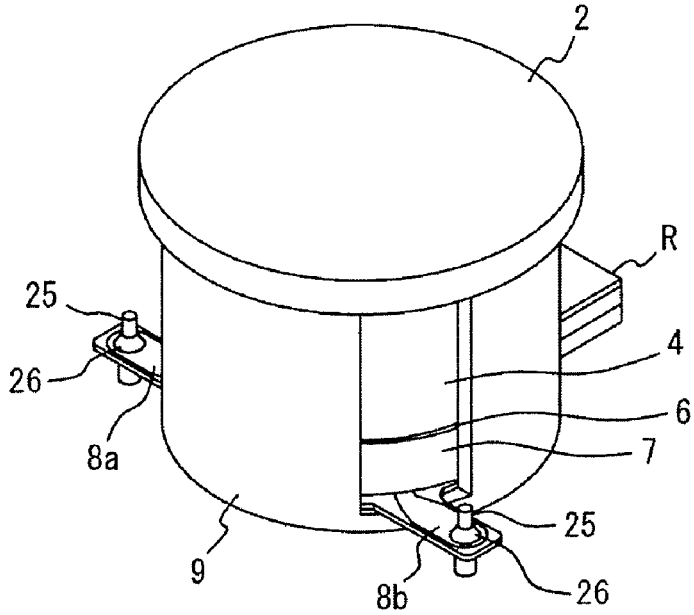
Fig. 14 PRIOR ART
FIG. 14 is a perspective view showing the appearance of a further conventional non-reciprocal circuit device.
Figure 15:
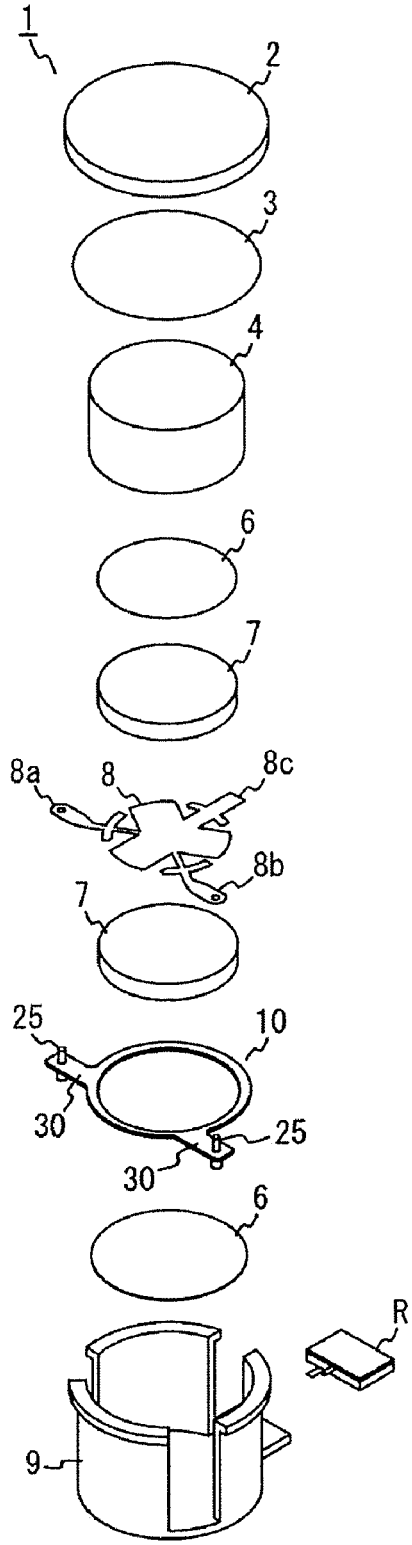
Fig. 15 PRIOR ART
FIG. 15 is an exploded perspective view showing the internal structure of the conventional non-reciprocal circuit device of FIG. 14.

For comparison, the non-reciprocal circuit device shown in FIGS. 14 and 15, which had a conventional structure, was produced. Its structural differences from the non-reciprocal circuit device of the present invention are; (a) it comprises two 1.0-mm-thick, disc-shaped garnet ferrite members 7, 7, (b) it comprises a 0.2-mm-thick shielding member 6 in place of the partition member 15 between an upper disc-shaped garnet ferrite member 7 and the permanent magnet 4, and (c) the connecting portion, branch lines and low-impedance lines of the strip line member 8 are designed to have input/output impedance of 50Ω. Because of the above structural differences, the non-reciprocal circuit device of Comparative Example was as high as 13.5 mm. Evaluation by a network analyzer revealed that this non-reciprocal circuit device had electric characteristics on the same levels as those of the present invention. It is thus clear that the present invention can make the non-reciprocal circuit device thinner without deteriorating its electric characteristics.

Figure 9:
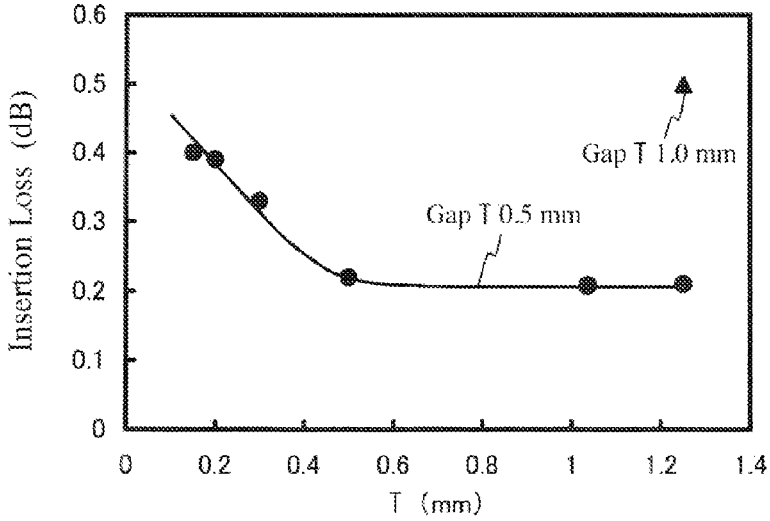
FIG. 9 is a graph showing the relation between insertion loss and a gap between a permanent magnet and a microstrip line member in the non-reciprocal circuit device according to one embodiment of the present invention.
Figure 10:
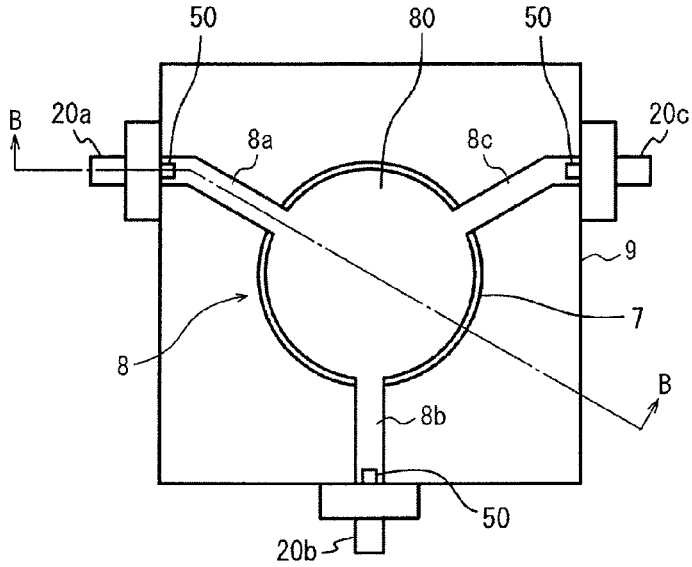
Fig. 10 PRIOR ART
FIG. 10 is a plan view showing the internal structure of a conventional non-reciprocal circuit device.
Figure 11:
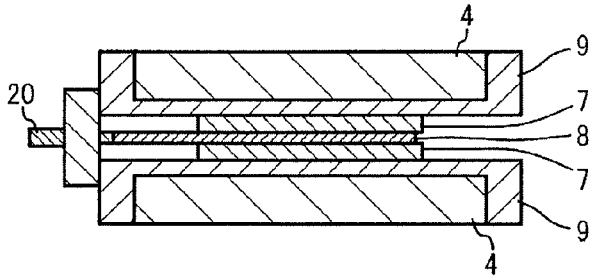
Fig. 11 PRIOR ART
FIG. 11 is a cross-sectional view taken along the line B-B in FIG. 10.
Figure 12:
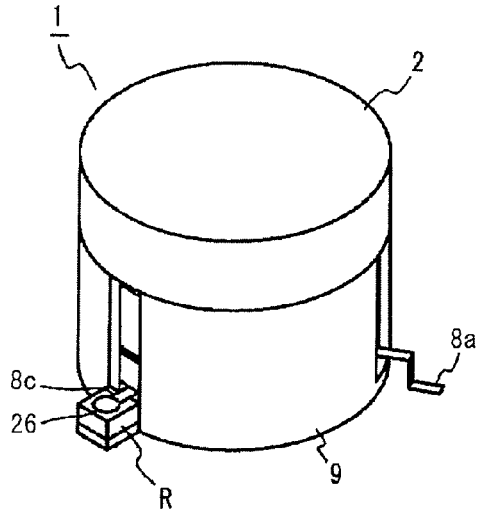
Fig. 12 PRIOR ART
FIG. 12 is a perspective view showing the appearance of another conventional non-reciprocal circuit device.
Figure 13:
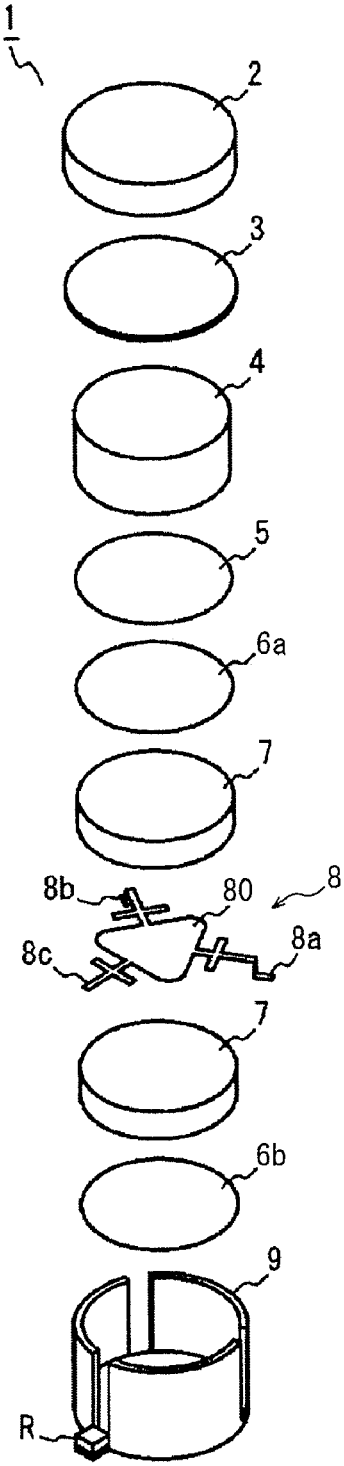
Fig. 13 PRIOR ART
FIG. 13 is an exploded perspective view showing the internal structure of another conventional non-reciprocal circuit device.

Next, using disc-shaped garnet ferrite members 7 as thick as 0.5 mm and 1.0 mm, respectively, the gap T between the permanent magnet 4 and the microstrip line member 8 was changed in a range from 0.15 mm to 1.25 mm. The height of the metal case 9 was also changed depending on the gap T and the thickness of the disc-shaped garnet ferrite member 7. Incidentally, the microstrip line member 8 having the same shape as in the present invention was used regardless of the thickness of the disc-shaped garnet ferrite member 7. The insertion loss of the resultant non-reciprocal circuit device was measured by a network analyzer. FIG. 9 shows the relation between the gap T and the insertion loss. When the disc-shaped garnet ferrite member 7 was as thick as 1.0 mm, the desired characteristics were not obtained by the mismatching of input/output impedance. It is difficult to remove this mismatching only by changing the shapes of the branch lines and low-impedance lines of the microstrip line member 8. On the other hand, when the disc-shaped garnet ferrite member 7 was as thick as 0.5 mm, excellent insertion loss characteristics were obtained at the gap T of 0.3-1.25 mm.

As described above, while the non-reciprocal circuit device having a conventional structure needs two 1.0-mm-thick, disc-shaped microwave ferrite members 7, the non-reciprocal circuit device of the present invention comprises only one thin, disc-shaped microwave ferrite member, providing excellent electric characteristics.

APPLICABILITY IN INDUSTRY

The non-reciprocal circuit device of the present invention is provided with reduced thickness without deteriorating electric characteristics, and has a simple structure advantageous for cost reduction.

What is claimed is:

1. A non-reciprocal circuit device comprising:

a metal case;

a ground plate disposed on an inner bottom surface of said metal case;

a resin member disposed on said ground plate and having an opening from which said ground plate is exposed;

a planar microwave ferrite member disposed in the opening of said resin member and having a thickness, a strip line member disposed on said planar microwave ferrite member; and a ferrite permanent magnet disposed via an air layer on said strip line member without another planar microwave ferrite member and another ground plate therebetween;

wherein said strip line member comprises a connecting portion constituted by strip electrodes radially extending from a center portion, branch lines radially extending from said center portion between said strip electrodes, low-impedance lines each integrally connected to each of said branch lines and extending along the periphery of said planar microwave ferrite member, and input/output electrodes each integrally connected to an outer side of each of said low-impedance lines, whereby said branch lines and said ground plate form microstrip lines, and said low-impedance lines and said ground plate form a grounded capacitor, said grounded capacitor acting as a matching circuit, and wherein a gap between said strip line member and said ferrite permanent magnet is within a range of 1 to 3 times the thickness of said planar microwave ferrite member.

2. The non-reciprocal circuit device according to claim 1, wherein a partition member made of a heat-resistant resin is disposed between said strip line member and said ferrite permanent magnet, and wherein said partition member has a flange for supporting a sidewall of said ferrite permanent magnet, said flange inscribing an inner surface of said metal case, and a bottom portion having a thickness substantially equal to said gap between said strip line member and said ferrite permanent magnet.

3. The non-reciprocal circuit device according to claim 1, wherein one of said input/output electrodes is connected to a termination resistor, wherein a low-impedance line connected to said input/output electrode is given a different shape from those of the other low-impedance lines, and wherein a branch line connected to said low-impedance line is given a different width from those of the other branch lines.

4. The non-reciprocal circuit device according to claim 1, wherein said metal case is plated with a metal having electric resistivity of $1.0\times10^{-7}$ Ω·m or less.

5. The non-reciprocal circuit device according to claim 1, wherein said opening is in a center portion of said resin member, wherein said metal case has a sidewall provided with notches, wherein said resin member has arms projecting from said notches, wherein each of said arms has an aperture in a tip end portion, into which a metal pin terminal is fixed, and wherein said resin member has a thickness substantially equal to that of said planar microwave ferrite member.

* * * * *